United States Patent [19]

Lamb

[11] Patent Number: 4,869,375

[45] Date of Patent: Sep. 26, 1989

[54] FLEXIBLE MEMBER FOR ATTACHING ARTICLES TO A DISHWASHER RACK

[76] Inventor: Robert E. Lamb, 516 K Waters Edge Dr., Newport News, Va.

[21] Appl. No.: 186,000

[22] Filed: Apr. 25, 1988

Related U.S. Application Data

[63] Continuation of Ser. No. 943,326, Dec. 19, 1986, Pat. No. 4,757,578.

[51] Int. Cl.[4] ..... A47G 19/08

[52] U.S. Cl. ..... 211/41; 24/482; 24/301; 24/129 W

[58] Field of Search ..... 24/301, 129 R, 140, 24/265 AL, 703, DIG. 16, 298-302, 117, 118, 122.3, 127, 129 W, 141, 482, 481, 143 A, 114.5

[56] References Cited

U.S. PATENT DOCUMENTS

| | | | |
|---|---|---|---|
| 200,665 | 12/1877 | Ottinger . | |
| 212,553 | 2/1879 | Haworth | 24/114.5 |
| 292,148 | 1/1884 | Travis et al. . | |
| 316,792 | 4/1888 | 5Kittleson | 24/114.5 |
| 510,875 | 12/1893 | Adams | 24/301 |
| 724,716 | 4/1903 | Kuehlhorn | 24/141 |
| 759,804 | 5/1904 | Brabrook | 24/142 |
| 858,842 | 7/1907 | Watson . | |
| 878,719 | 2/1908 | Gardyne | 24/300 X |
| 1,767,732 | 6/1930 | Breadon | 24/143 A |
| 1,835,068 | 12/1931 | Livermore | 24/122.3 |
| 1,887,491 | 11/1932 | Johnson . | |
| 2,035,717 | 3/1936 | Pentz | 24/302 |
| 2,085,320 | 7/1937 | Kolstrand . | |
| 2,125,278 | 8/1938 | Andrews et al. | 24/129 W |
| 2,192,946 | 3/1940 | Towner | 24/301 X |
| 2,367,836 | 1/1945 | Brown | 24/141 X |
| 2,417,465 | 3/1947 | Botts | 24/114.5 X |
| 2,870,502 | 1/1959 | Sasse | 24/302 X |
| 3,701,572 | 10/1972 | Velasquez | 24/143 A X |

FOREIGN PATENT DOCUMENTS

| | | | |
|---|---|---|---|
| 594413 | 10/1932 | Fed. Rep. of Germany . | |
| 605513 | 10/1932 | Fed. Rep. of Germany . | |
| 1075589 | 4/1954 | France . | |
| 358532 | 4/1938 | Italy | 24/114.5 |
| 312342 | 12/1955 | Switzerland | 63/3 |

*Primary Examiner*—Kenneth J. Dorner
*Assistant Examiner*—Laurie K. Cranmer
*Attorney, Agent, or Firm*—Sandler & Greenblum

[57] ABSTRACT

A strap is provided for retaining at least one article on a rack. The strap comprises at least three spaced apart, substantially annular eyelets, and at least one elongated resilient cord. The cord serves to resiliently attach the eyelets to each other. The third eyelet can be positioned either between the first two eyelets in a substantially parallel fashion or in a fashion which is perpendicular to the longitudinal axis of the cord that fits around the cord. Second and third cords can be provided to provide an assembly which is more flexible in terms of attaching one or more breakable items to a dishwasher rack, and to minimize wear and breakage on the articles during the dishwashing process.

7 Claims, 2 Drawing Sheets

FLEXIBLE MEMBER FOR ATTACHING ARTICLES TO A DISHWASHER RACK

This is a continuation of application Ser. No. 943,326 filed Dec. 19, 1986.

BACKGROUND OF THE DISCLOSURE

1. Field of the Invention

The present generally invention relates to a flexible strapping assembly which is adapted to be attached to racks, and more specifically to a variety of elastic strap type devices which can be attached to the upstanding fingers of a dishwasher rack for securely positioning articles in a predetermined position within the rack to minimize movement of the articles during a dishwasher cleaning cycle and to minimize breakage and chipping thereof.

2. Discussion of Prior Art

It is a common difficulty, when using automatic dishwashers, that undesirable movement results in chipping and/or breakage of articles such as glasses, cups, dishes and/or plates. Generally, during a dishwashing cycle, these articles, which are placed relatively loosely within the dishwasher rack, are subject to substantial movement and subsequent damage from contact with other articles or the rack frame.

A variety of straps and eyelets or rings have been used in the prior art for different purposes. KOLSTRAND, U.S. Pat. No. 2,085,320, discloses a trolling rubber which is attached to a bolt at one end and which has a plurality of fishing hooks attached at its other end underwater. OTTINGER, U.S. Pat. No. 200,665, discloses a fire escape comprising a twine or cord which has one looped end and a slide or clasp around the rope. TRAVIS et al., U.S. Pat. No. 292,148, similarly disclose a fire escape having a looped cord at one end and a guide or slide positioned around an elongated portion of the rope. WATSON, U.S. Pat. No. 858,842, discloses a ring which is adapted to retain a hook at one end of an umbrella. JOHNSON, U.S. Pat. No. 1,887,491, discloses a decoy hobble which includes a strap and a ring for supporting the decoy in a substantially fixed position on top of the water. BOIDIN, French Pat. No. 1,075,589, discloses a ring for attaching two straps to each other. SCHRODER, German Pat. Nos. 594,413 and 605,513, both disclose apparatus for attaching two flexible cords to each other.

None of these apparatus, however, discloses or suggests the use of a flexible elongated member for the purpose of securing one or more frangible articles in a rack; and clearly non disclose the use of such device for flexibly and securely retaining frangible articles in one or more racks of an automatic dishwasher.

SUMMARY OF THE INVENTION

Accordingly, it is a general object of the present invention to provide a new and improved device for securely fastening breakable articles in a dishwasher rack.

Another object of the present invention is to provide a new and improved strap assembly for securely fastening breakable articles within a dishwasher rack, which assembly can be flexibly and variably positioned on the rack by being attached to the generally upright fingers of the rack.

Yet a further object of the present invention is to provide a new and improved device for flexibly and securely positioning frangible articles within a dishwasher rack, which device is adapted to fit variously sized articles and which is therefore stretchable/flexible to that end.

Still a further object of the present invention is to provide a new and improved strapping device for flexibly and securely fastening breakable articles in a dishwasher rack which can come in a variety of embodiments to securely position one or more of such articles of various sizes and shapes on the rack.

Another object of the present invention is to provide a new and improved device for flexibly and securely attaching breakable articles to a dishwasher rack and which includes a process for manufacturing the device.

The above and other objects, features and advantages of the present invention will be more fully described throughout this application.

SUMMARY OF THE INVENTION

In a first aspect thereof, the present invention provides a strap assembly for retaining at least one article on a rack; the strap assembly comprises at least three spaced apart, substantially annular eyelets; at least one elongated resilient cord comprising means for resiliently connecting a first one of the eyelets to a second one of the eyelets; and means for positioning a third one of the eyelets at a location on the at least one cord which is substantially centrally located between the first eyelet and the second eyelet.

The strap assembly can comprise two elongated resilient cord sections, with a first elongated cord section connecting the first eyelet to the third eyelet, and a second elongated cord section connecting the second eyelet to the third eyelet. Each cord section may be connected to the exterior peripheral surface of each of the eyelets; and each of the eyelets comprises a brass ring. In this fashion, a single cord can be used for two embodiments of the strapping assembly.

Each of the eyelets can either be coated with rubber, or can remain uncoated. Further, each of the eyelets can include a central rubber grommet positioned within the interior of the eyelet, and each of the cord sections can comprise a rubber cord encased in a nylon sleeve material. The cord sections can be of different lengths, or each of the cord sections can be the same length.

The strap assembly can further comprise a third cord section and a fourth eyelet, with the third cord section being attached at a first end to the second eyelet and attached at a second end thereof to the fourth eyelet. This cord section is attached to an exterior peripheral surface of the each of the third and fourth eyelets. The length of the third cord section may be less than the length of each of the first and second cord sections, or all of the cord sections can have equal lengths.

The third eyelet can alternately be loosely fitted about the circumference of the at least one cord along a plane which is substantially perpendicular to the longitudinal axis of the cord. In this case, the strap assembly will further comprise a second cord which is substantially perpendicular to the first cord and which is connected about the periphery of a fourth eyelet at a second end of the second cord, the second cord being attached at its first end to the third eyelet. A third cord is positioned in a substantially parallel fashion to the first cord, and fifth and sixth eyelets are attached to first and second ends of the third cord, respectively. The second cord can be shorter than either or both of the first and third cords.

Each of the eyelets can comprise a central hub having crimpable or foldable upper and lower flanges; each flange has an edge portion adapted to be crimped or folded into a position substantially perpendicular to the flanges, wherein at least one cord or cord section is securely positioned between the hub and the folded flanges of each eyelet.

In another aspect, the present invention provides for a method of forming a strap assembly which is adapted to be attached to a rack, the strap comprising at least two spaced apart annular eyelets and a resilient cord attached to the eyelets, the method comprising stretching the resilient cord around the periphery of each of the eyelets, and thereafter folding or crimping at least one flange on each eyelet about said cord in order to securely encase the cord between the interior hub and the flanges of each of the eyelets.

The method involves folding an upper and/or a lower flange on each eyelet about the cord; and can further comprise positioning a third eyelet about the cord in a substantially perpendicular fashion. In such a case, a second cord having eyelets at its ends will be positioned within the third eyelet, such that the two cords will be substantially parallel to each other.

BRIEF DESCRIPTION OF THE DRAWINGS

The above and other objects, features and advantages of the present invention will be more fully described in the following detailed description, with respect to the accompanying drawings, in which like reference numerals represent similar parts throughout, and wherein.

DETAILED DESCRIPTION OF THE INVENTION

Figure 1:
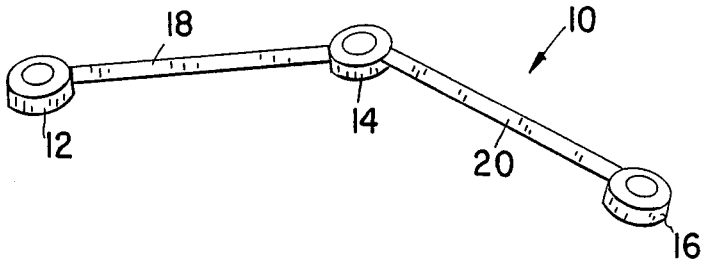
FIG. 1 is a perspective view of a first embodiment of a device for flexibly and securely fastening one or more articles within a dishwasher rack.
Figure 4:
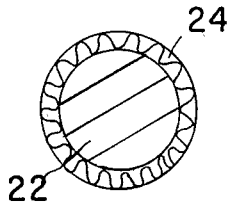
FIG. 4 is a cross-sectional view taken along line 3—3 of FIG. 1.
Figure 5:
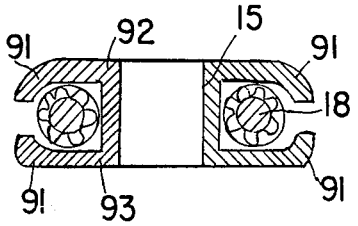
FIG. 5 is a sectional view of the attachment between an eyelet and a cord in accordance with the present invention.

A first embodiment of the strap assembly of the present invention is illustrated in FIG. 1. A strap assembly 10 is provided having a single elongated elastic cord including resilient cord sections 18 and 20; and first, second and third annular brass rings 12, 14, and 16, respectively. The elastic cord sections, when in their unstretched state, are substantially equal in length. Each of the elastic cords used in the invention preferably comprises a rubber elastic cord center or core 22 which is encased in a nylon weave material 24, as best illustrated in FIG. 4. The first cord section 18 and second cord section 20 are attached to the outer periphery of the first and second eyelets 12 and 16, respectively; and the second cord section 20 is attached at a first end to third brass eyelet 14, and the first cord section 18 is attached at a first end to eyelet 12 and at a second end to third brass eyelet 14. Each cord section is attached to the eyelets as shown in FIG. 5.

Figure 2:
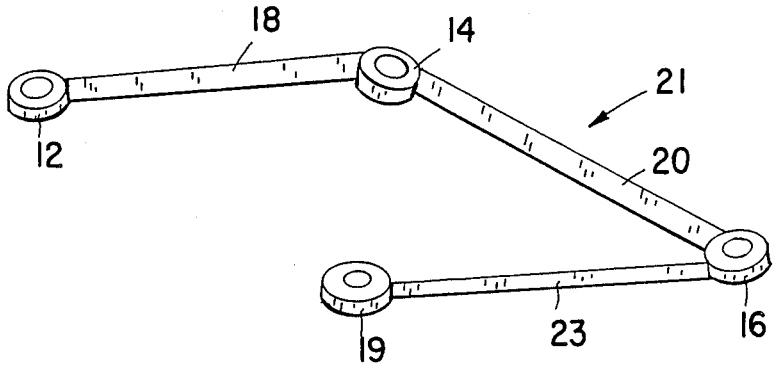
FIG. 2 is a perspective view of a second embodiment of a device similar to that of FIG. 1.

FIG. 2 illustrates a second strap assembly 21 which is similar to assembly 10 illustrated in FIG. 1, but which additionally includes a third cord section 23 and a fourth eyelet 19. Cord section 23 is substantially identical to first and second cord sections 18 and 20 and is attached at a first end to second eyelet 16 and at a second end to fourth eyelet 19. Although the cord section is preferably the same length as the first and second cord sections, it could be made shorter if desired.

Figure 3:
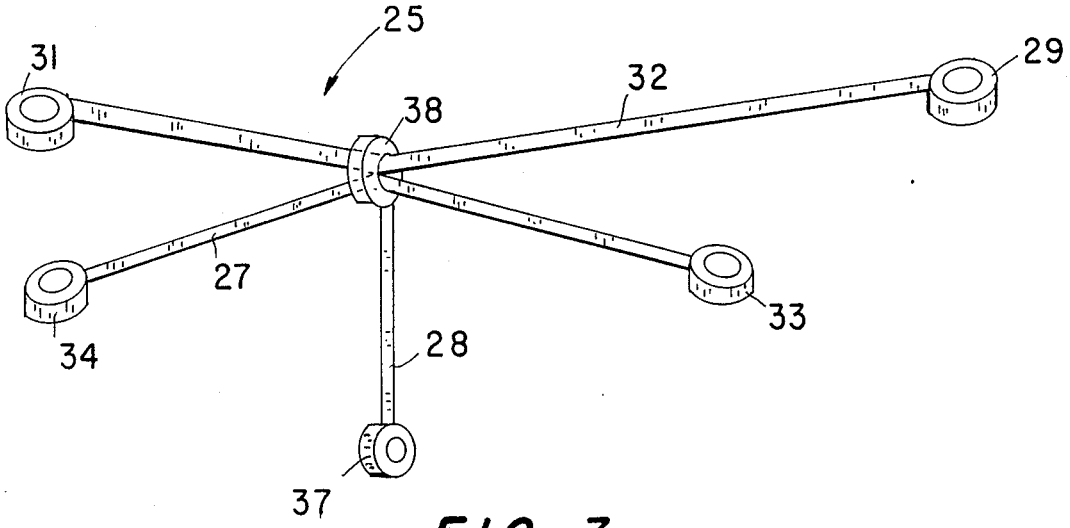
FIG. 3 is a perspective view of yet a third embodiment of a device similar to that of FIG. 1.

FIG. 3 illustrates a third embodiment 25 of the strap assembly. This embodiment includes a first cord 32 which is attached at a first end to first eyelet 29 and at a second end to second eyelet 31. This first cord 32 is similar in construction to the cord of FIG. 1. A second cord 28 is provided having a third eyelet 38 which is positioned along a substantially central portion of cord 32. Rather than being attached at its periphery, as are the eyelets in the embodiments of FIGS. 1 and 2 and eyelets 29 and 31 in this third embodiment of the strap assembly, eyelet 38 is positioned (loosely) substantially perpendicularly to the longitudinal axis of cord 32 and is flexibly positioned thereover, as best illustrated in FIG. 3. The second elastic cord 28 is attached at its first end to an outer periphery of eyelet 38 and at a second end to an outer periphery of a fourth eyelet 37. The second cord 28 is preferably shorter than cord 32, but can be made of any desired length in accordance with the articles which are to be attached to the dishwasher rack when the eyelets of the strap are positioned over the generally upwardly directed fingers of the dishwasher rack.

Still referring to FIG. 3, a third cord or strap 27 is provided which can be of substantially the same length as cord 32, and which includes a fifth eyelet 33 attached to one end of the third cord and a sixth eyelet 34 attached to a second end of cord 27. The third eyelet 38 is generally slidably or guidably positioned about the periphery of cord 35, in the same manner that is positioned about cord 32. Cords 32 and 27 can thus be found in a position substantially parallel to each other.

FIG. 4 illustrates, in cross section, the contour and materials which preferably form each of the elastic cord sections 18, 20 and 23, and individual cords 27, 28, and 32. More specifically, each of the cords and sections comprises an elastic material, e.g., a rubber core 22, about which a nylon material 24 is woven, as one or more braids, in order to encase the nylon cords. As in the other embodiments, the elastic nylon cord can be formed, e.g., from a number 840 Denia nylon woven around six pure rubber strands forming the core. Such a cord is capable of between 90 and 100% stretch from a relaxed condition. Although this specific material is detailed herein, the present invention should not be construed as being limited to a cord construction using such materials. Elasticity is necessary for the cords, however, in order to enable them to stretch sufficiently so as to accommodate a variety of differently sized articles or a number of articles on the dishwasher rack.

Each of the brass eyelets 12, 14, 16, 19, 29, 31, 33, and 34 is preferably formed of annular brass material having a minimum inside diameter of approximately 3 millimeters and a maximum outside diameter of approximately 8 millimeters. Alternately, each of the brass eyelets can be rubber coated if it is desired to provide some resiliency and greater resistance against wear. A central rubber grommet can be positioned within the interior of each eyelet, and attached conventionally, e.g., by adhesive, in order to increase wear of the eyelets and provide a better grip on the rack fingers when the eyelets are secured on the rack.

Figure 6:
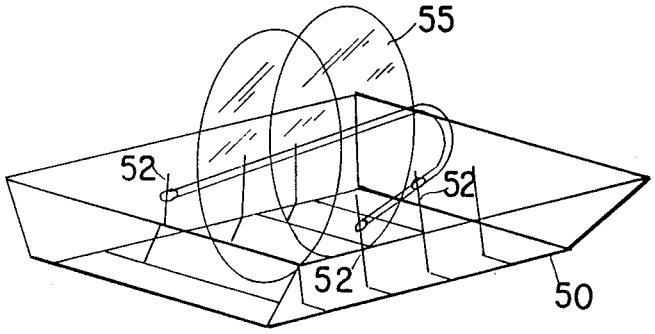
FIG. 6 is a perspective view of a dishwasher rack with a plurality of frangible or breakable articles therein which are retained in a relatively fixed position by a strap formed in accordance with the present invention.

FIG. 6 illustrates the proper use of one of the embodiments of the present invention, e.g. a typical dishwasher (or other) racks. The rack includes a plurality of upwardly extending fingers 52. In a typical configuration, one or more glass or china plates 55 (or drinking glasses) are positioned against (or over) the fingers, respectively. One or more strap assemblies 10, 21, or 25 are positioned so that their eyelets are placed over several fingers and forced downwardly until their inner diameters relatively securely engage the outer diameters of the fingers, with the fingers being substantially frustoconical. Because of the flexibility and resiliency of each of the straps, the rings can be positioned in virtually any desired fingers or upwardly standing rack structure and used to position around otherwise breakable article(s) to securely position the article(s) on the rack. During operation of the dishwasher, which entails a great deal of shaking, the frangible items will be relatively securely held in place and will thus minimize breaking and chipping.

Each of the strap assemblies is made by stretching the nylon elastic cord, or cord section, as the case may be, around the periphery of the eyelet hub 15, as shown in FIG. 5, to permit the elastic cord to reduce its diameter to as low a value as possible. Thereafter, the edges 91 of eyelet flanges 92 and 93 are folded or crimped into a substantially perpendicular position, with respect to the flanges, by applying pressure to the open ends of the eyelet, thereby encasing the stretched elastic cord between the flanges and eyelet hub 15. In this fashion, the finished product can be stretched to its fullest extent without separation of the eyelets or separation between the eyelets and the cord. Although one particular embodiment of attaching the cords to the eyelets is illustrated, other methods could be used, e.g., adhesive, tape, or conventional fastening means. Using the crimped flanges to attach the cords to the eyelets, however, permits a single cord (of about two centimeter in length) to be used in each of the embodiments of FIGS. 1 and 2.

As noted above, the eyelets serve to fasten the elastic strap assembly in a variety of selected positions by being pushed down around the generally upright fingers of a dishwasher rack or other rack. The elastic nylon cord is stretched around the item or items to be washed, securing one or more items (with each of the cord assemblies) in place prior to washing. The embodiments of FIGS. 1 and 2 are preferably used for small items or one or two item securements, whereas the third embodiment, as illustrated in FIG. 3, is more specifically adapted for use with three or more frangible items positioned in the rack, which articles may be of various sizes and shapes.

The specific embodiments discussed herein can be varied within the scope of the present invention, and obvious modifications and embodiments are contemplated as being within such scope.

What is claimed is:

1. A strap assembly in combination with a dishwasher rack having a plurality of generally upwardly extending fingers, said strap assembly comprising:

(a) at least three spaced apart, substantially annular eyelets, each of said eyelets having a central hub which is positioned so as to engage a respective one of said upwardly extending fingers, and each eyelet including upper and lower flanges extending outwardly from respective upper and lower surfaces of said hub, at least one of said flanges having an edge portion which is crimped or folded into a position substantially perpendicular to the remainder of said at least one of said flanges; and (b) at least one elongated resilient cord resiliently connecting a first one of said eyelets to a second one of said eyelets, said at least one cord being positioned between the exterior peripheral surface of said hub and the folded edge portions of flanges on each of said first and second eyelets, wherein said at least one elongated resilient cord further comprises means for resiliently connecting said second one of said eyelets to a third one of said eyelets, said at least one cord being positioned between said exterior peripheral surface of said hub and the folded edge portions of said third eyelet, wherein said third one of said eyelets is positioned at a location on said at least one cord which is substantially centrally located between said first eyelet and said second eyelet.

2. A strap assembly in accordance with claim 1 comprising two sections of said elongated resilient cord, a first elongated cord section connecting said first eyelet to said third eyelet, and a second elongated cord section connecting said second eyelet to said third eyelet.

3. A strap assembly in accordance with claim 2, wherein each of said cord sections are the same length.

4. A strap assembly in accordance with claim 2, further comprising a third cord section and a fourth eyelet, said third cord section being attached at a first end to said second eyelet and attached at a second end thereof to said fourth eyelet.

5. A strap assembly in accordance with claim 4 wherein the length of each of said cord sections is approximately equal.

6. A strap assembly in accordance with claim 1, wherein each of said eyelets comprises a brass ring.

7. A strap assembly in accordance with claim 1, wherein each of said at least one cords comprises a rubber cord encased in a nylon sleeve.

* * * * *